US005589919A

United States Patent [19]

Ikunami et al.

[11] Patent Number: 5,589,919

[45] Date of Patent: Dec. 31, 1996

[54] TONER CARTRIDGE AND COLOR IMAGE FORMING APPARATUS IN USE THEREWITH

[75] Inventors: Yoshikazu Ikunami; Satoshi Minami; Yozo Fujii, all of Hachioji, Japan

[73] Assignee: Konica Corporation, Japan

[21] Appl. No.: 423,314

[22] Filed: Apr. 18, 1995

[30] Foreign Application Priority Data

Apr. 26, 1994 [JP] Japan ..... 6-088807
May 26, 1994 [JP] Japan ..... 6-112812

[51] Int. Cl.[6] ..... G03G 15/08

[52] U.S. Cl. ..... 399/262; 399/223; 399/58

[58] Field of Search ..... 355/245, 260, 355/326 R, 327; 222/DIG. 1

[56] References Cited

U.S. PATENT DOCUMENTS 4,878,091 10/1989 Morita et al. ..... 355/260
5,150,162 9/1992 Saito ..... 355/260
5,455,662 10/1995 Ichikawa et al. ..... 355/260

*Primary Examiner*—Joan H. Pendegrass
*Attorney, Agent, or Firm*—Jordan B. Bierman; Bierman and Muserlian

[57] ABSTRACT

A toner cartridge in use with an image forming apparatus such as a printer. The toner cartridge includes a cylindrical container for accommodating toner, and the cylindrical container further includes; an opening at one side for discharging the toner accommodated in the cylindrical container; an spiral protrusion, provided on an inner circumferential surface of the cylindrical container, for conveying the toner toward the opening in the cylindrical container and for discharging the toner from the opening to outside the cylindrical container when the cylindrical container is rotated on an axis by a driver of the image forming apparatus; and a scoop, attached to the opening, for scooping the toner so that the spiral protrusion discharges the toner from the opening when the opening is at a position upper than a horizontal line extended through the axis.

16 Claims, 16 Drawing Sheets

TONER CARTRIDGE AND COLOR IMAGE FORMING APPARATUS IN USE THEREWITH

BACKGROUND OF THE INVENTION

The present invention relates to a toner cartridge for supplying toner accommodated in the toner cartridge attached to a toner supply section of an image forming apparatus.

Performance of office automation apparatus such as a printer and copier has been enhanced recently. In this trend of the times, reduction of the size and cost of the apparatus is demanded. Therefore, it is required to reduce the size and cost of an expensive, large and complicated color image forming apparatus. After the color image forming apparatus has been downsized, it tends to be applied for personal use.

Concerning the quality of printing, there is a demand for an electrophotographic printing system that is more advantageous than other systems such as a dot-impact, thermal-transfer and ink-jet system.

Therefore, it is necessary to develop and offer a small handy color image forming apparatus of electrophotography, the cost of which is low, and the performance of which is high.

Compared with a monochromatic image forming apparatus, it is difficult to downsize a color image forming apparatus because a plurality of developing units of different colors are provided in the color image forming apparatus. In the case of a common color image forming apparatus having 4 developing units of Y (yellow), M (magenta), C (cyan) and K (black), the apparatus is downsized by using small developing units and a small photoreceptor for image formation. However, when each developing unit arranged around the photoreceptor is downsized, an amount of toner accommodated in the developing unit is reduced, which causes a problem. In other words, it is impossible to downsize the apparatus having a toner accommodating section in the developing unit. In order to solve the above problem, the toner accommodating section for supplying toner is arranged outside of the developing unit. Since a plurality of toner supply sections must be arranged in a color image forming apparatus, it is necessary to reduce the dimensions of the toner supply sections for accomplishing the object of downsizing.

Conventionally, there are provided 2 types of toner supply sections. One is a type in which a toner hopper for accommodating toner is arranged in the image forming apparatus and only toner is supplied from a toner container to the hopper, that is, a toner cartridge is not arranged in the image forming apparatus. The other is a type in which a toner cartridge is arranged in the image forming apparatus so that toner is supplied to the developing unit from the toner cartridge. When importance is attached to maneuverability of the apparatus, the cartridge type is more effective than the type in which toner is manually supplied without using the cartridge.

For this reason, the type in which the toner cartridge is arranged in the image forming apparatus is employed. A conventional image forming apparatus having a toner cartridge will be explained here.

There are provided 4 types of toner cartridges as described below.

(1) A cylindrical toner cartridge is attached in parallel with a rotational center of the developing sleeve of the developing unit while an opening portion of the toner cartridge is located upward. Then the toner cartridge is rotated by a half revolution so that toner can be supplied into the cartridge.

(2) A bottle-shaped toner cartridge is connected with a toner supply section while an opening portion of the toner cartridge is located upward. Then the bottle is rotated by a half revolution so that toner can be supplied into the bottle.

(3) A cylindrical toner cartridge is held horizontally, on the inner circumferential surface of which spiral protrusions are provided. Then the toner cartridge is rotated, and toner accommodated in the cartridge is conveyed to an end of the cartridge. The conveyed toner is discharged from an opening formed at the end to the toner supply section.

(4) Type (4) is a variation of type (3). In the type (4), a screw for conveying toner is arranged in the toner cartridge.

When importance is attached to the maneuverability of the apparatus, the types (1) and (2) have the following disadvantages:

In the types (1) and (2), toner is supplied into the cartridge when the cartridge is attached. Therefore, the toner cartridge must be shaken before the cartridge is attached so that the accommodated toner can be fluidized.

In order to prevent the accommodated toner from clogging in the cartridge, countermeasures must be taken, so that the structure becomes complicated and the dimensions are extended. As a result, the cost is increased.

From the viewpoint of structure, it is obvious that the type (4) is more expensive than the type (3).

Due to the foregoing, the toner cartridge of type (3), on the inner circumferential surface of which spiral protrusions are provided, is advantageous since its maneuverability is high.

According to the prior art, the apparatus can not be sufficiently downsized from the following reasons:

Toner conveyed to an end surface of the toner cartridge is discharged from the end surface portion (the end surface or the circumferential surface of the end). However, the toner hopper or developing unit to which the toner is supplied is located at a position lower than the discharging section. Examples in which the opening is located at the circumferential surface are disclosed in Japanese Patent Publication Open to Public Inspection Nos. 1681/1992, 477/1992 and 2881/1991. In all examples described above, a portion for receiving toner discharged from the cartridge is located at a position lower than the cartridge. A conveyance section for conveying the toner to the next unit (for example, the developing unit) is illustrated in the drawing of each example. However, since the device functions as a toner supply unit, it is necessary to arrange the device at a higher position. Under the toner cartridge, a wide dead space is generated at a position where the toner conveyance unit is not arranged. Due to the foregoing, it is difficult to downsize the image forming apparatus.

Next, examples will be explained, in which toner is discharged from the end surface of the toner cartridge. The examples are disclosed in Japanese Patent Publication Open to Public Inspection No. 266380/1990 and Japanese Patent Publication Nos. 6194/1993 and 60387/1988. In the above examples, the opening portion of the toner cartridge functions to discharge toner at a position lower than the rotational shaft of the cartridge. That is, the discharged toner must be received by the receiving section located at a position lower than the opening section. Accordingly, the toner receiving section is located at a position lower than the lowermost surface of the toner cartridge. From the viewpoint of downsizing, the above examples are the same as the example in which the opening section is provided in the periphery of the toner cartridge. Therefore, the above examples are disadvantageous in downsizing. The above examples are disadvantageous in that the dead space is generated under the toner cartridge, so that the height of the device is increased.

Due to the foregoing, even in the apparatus in which the toner cartridge having spiral protrusions on the inner circumferential surface is used, a dead space is generated and the dimensions of the apparatus are extended.

The above problems are solved by the present invention. The first object of the present invention is to provide a toner cartridge by which a compact and handy toner supply section can be realized at low cost when a toner discharge section of the toner cartridge is located at a position higher than a rotational center of the toner cartridge, and a toner receiving section (toner hopper) for receiving toner discharged from an opening section is located on the substantially same surface as the toner cartridge.

In order to reduce the width and length of an image forming apparatus, it is necessary to the external dimensions of a sheet conveyance passage for conveying sheets. In the conventional example in which a plurality of toner supply sections are provided, the toner supply sections are arranged outside of the sheet conveyance passages. Accordingly, the width of the apparatus becomes equal to the total of the width of the sheet conveyance passage and the width of the toner supply section. In other words, the width of the apparatus is excessively increased. In order to improve the maneuverability, especially in order to improve the performance of jam clearance, there are provided two types of image forming apparatus.

(1) One is a clam-shell type image forming apparatus.

(2) The other is an image forming apparatus in which a process unit integrally having a photoreceptor, developing units and cleaning unit can be removed from the main body of the image forming apparatus.

In order to reduce the dimensions of the color image forming apparatus at a low cost, type (2) is more effective than type (1). Type (2) is primarily applied to a monochromatic page printer, and the toner supply section is not individually provided but integrated with each developing unit. Therefore, technique of type (2) can not be applied to the image forming apparatus, that is, according to the prior art, it is impossible to reduce the dimensions of the apparatus and improve the maneuverability at the same time. In order to develop an inexpensive small color image forming apparatus, it is necessary to effectively arrange a plurality of toner supply sections in a sheet conveyance passage. It is also necessary to improve the maneuverability of the apparatus in the cases of jam clearance and maintenance of the apparatus.

The above problems are solved by the present invention. The second object of the present invention is to provide a color image forming apparatus characterized in that: the dimensions of a toner supply section are reduced; and the toner supply section is effectively arranged so as to downsize the apparatus. In this way, in the cases of toner supply, jam clearance and maintenance, the apparatus can be easily and simply handled.

SUMMARY OF THE INVENTION

The first object of the present invention is accomplished by a toner cartridge described below:

The toner cartridge includes a cylindrical container for accommodating toner having an opening for discharging toner accommodated in the container and also having spiral protrusions on the inner circumferential surface. The toner cartridge is arranged in the image forming apparatus approximately horizontally, and toner is conveyed and discharged when the container is rotated. A scooping section is attached to the opening of the container, and toner can be discharged from the container by the scooping section at an upper portion of the rotational axis of the toner cartridge.

The second object of the present invention is accomplished by a color image forming apparatus which includes: an image forming body; a charging means for charging the image forming body; an exposure means for forming a latent image on the image forming body; plural developing means, each having a developing sleeve, for developing the latent image so as to obtain a toner image; and a plurality of toner supply means for supplying toner to the developing means, in which the plural toner supply means are aligned parallel on an axis of the developing sleeve so as to form a group on the same plane, and the toner supply means group is arranged upper on an axis to which the plural developing means are arranged.

DETAILED DESCRIPTION OF THE INVENTION

Previous to the explanation of the example of the present invention, the arrangement and mode of operation of a color image forming apparatus to which the toner cartridge of the present invention is assembled will be explained with reference to FIGS. 1 to 8.

Figure 1:
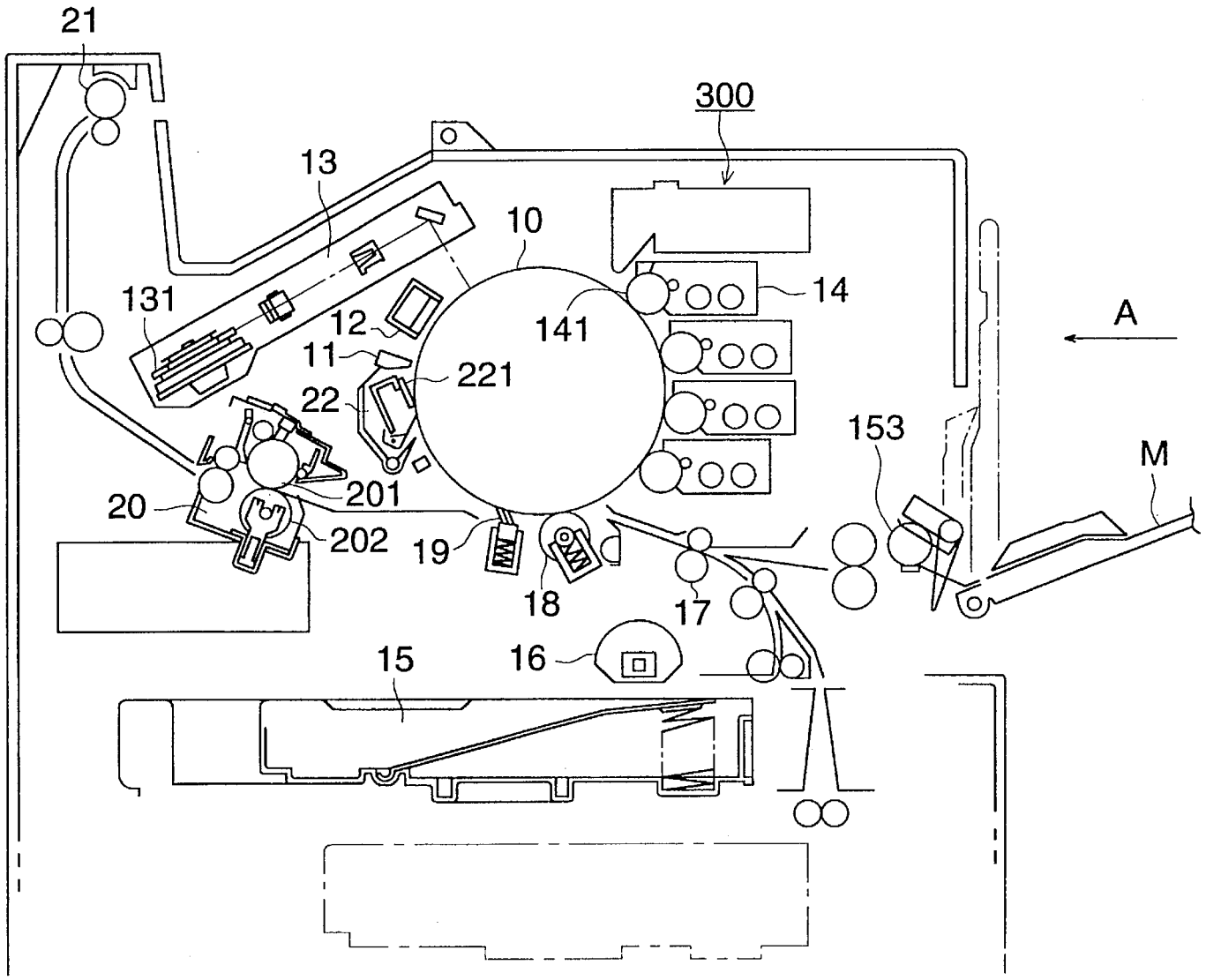
FIG. 1 is a sectional arrangement view of the color image forming apparatus of the present invention.

In FIG. 1, numeral 10 is a photoreceptor drum that is an image forming body. The photoreceptor drum 10 is composed in such a manner that an OPC photoreceptor is coated on the drum. The photoreceptor drum 10 is grounded and rotated clockwise. Numeral 12 is a scorotron charger, which gives a uniform charge of VH onto the circumferential surface of the photoreceptor drum 10 by the action of corona discharge conducted by a grid, the potential of which is maintained at VG, and also by a corona discharge wire. Previous to the charging operation conducted by the scorotron charger 12, in order to erase the hysteresis of the photoreceptor, exposure is conducted on the circumferential surface of the photoreceptor by PCL11 in which light emitting diodes are used. In this way, the circumferential surface of the photoreceptor is electrically discharged.

After the photoreceptor has been uniformly charged, image exposure is conducted by the image exposure means 13 in accordance with an image signal. By the image exposure means 13, optical scanning is conducted in the following manner:

A laser diode not illustrated in the drawing is used as a light emitting source. Emitted light passes through a rotational polygonal mirror 131, fθ lens and others, then the optical path of emitted light is curved by a reflecting mirror 132. When the photoreceptor drum 10 is rotated, that is, subsidiary scanning is made by the rotation of the photoreceptor drum 10, a latent image is formed. In this example, a character portion is exposed to light, and a reversal latent image is formed so that an electric potential of the character portion is maintained to be a low value VL.

Developing units 14 having carrier and developer composed of toners of yellow (Y), magenta (M), cyan (C) and black (K) are arranged along the periphery of the photoreceptor drum 10. First, development of the first color is made by a developing sleeve 141 in which a magnet is installed so that developer is held on the surface of the developing sleeve 141 during its rotation. Developer is composed of carrier and toner, wherein the core of carrier is made of ferrite and the surface of the core is coated with insulating resin, and toner is mainly made of polyester and further a charge control agent, silica and titanium oxide are added to toner. By the layer forming means, thickness of the layer of developer on the developing sleeve 141 is regulated to be 100 to 600 μm, and the thus regulated developer layer s conveyed to a developing region.

A clearance between the developing sleeve 141 and the photoreceptor drum 10 in the developing region is maintained to be 0.2 to 1.0 mm which is larger than the thickness of the developer layer. $V_{AC}$ of AC bias and $V_{DC}$ of DC bias are superimposed and impressed between the developing sleeve 141 and the photoreceptor drum 10. $V_{DC}$, $V_H$ and toner have the same charging polarity. Therefore, toner that has been released from carrier by the trigger action of $V_{AC}$ is not deposited on a portion of potential VH which is higher than $V_{DC}$ but deposited on a portion of VL which is lower than $V_{DC}$. In this way, visual image formation (reversal development) is made.

After the visual image of the first color has been formed, the image forming process advances to the formation of the second color. The photoreceptor drum 10 is uniformly charged by the scorotron charger 12 again, and a latent image according to image data of the second color is formed by the image exposure means. In this case, discharging that has been conducted in the image forming process of the first color is not conducted here because toner of the first color deposited on the image portion scatters due to a sudden drop of the potential.

In this way, the potential of the overall circumferential surface of the photoreceptor 10 becomes VH. In a portion on the circumferential surface of the photoreceptor 10 where the first color image does not exist, a latent image is formed and developed in the same manner as that of the first color. However, in a portion where the first color image exists and development is conducted again, a latent image of VM' is formed by light-shielding of the first color toner and the electric charge of toner itself. Therefore, development is made in accordance with a potential difference between $V_{DC}$ and VM'. When the first color development is made in this overlap portion of the first and second colors while a latent image of VL is formed, the first and second colors are not well-balanced. Therefore, an amount of exposure light of the first color is reduced so that the potential can be maintained to be intermediate and the inequality of VH>VM>VL can be established.

Concerning the third and fourth colors, image formation is carried out in the same manner as that of the second color. Therefore, a visual image of 4 colors is formed on the circumferential surface of the photoreceptor drum 10.

On the other hand, recording sheet P conveyed out from the sheet feed cassette 15 by a semicircular roller 16 is temporarily stopped, and in timed relation with transfer, recording sheet P is fed to the transfer region by the rotation of the sheet feed roller 17.

In the transfer region, in timed relation with transfer, a transfer roller 19 comes into pressure contact with the circumferential surface of the photoreceptor drum 10, so that recording sheet P is interposed between the transfer roller 18 and the circumferential surface of the photoreceptor drum 10, and a multi-color image is transferred onto recording sheet P.

Next, recording sheet P is electrically discharged by a separation brush 19 that has come into pressure contact substantially at the same time. Therefore, recording sheet P is separate from the circumferential surface of the photoreceptor drum 10 and conveyed to a fixing unit 20. In the fixing unit 20, toner is fused when recording sheet P is heated by a heat roller 201 and pressed by a pressure roller 202. After that, recording sheet P is sent outside of the apparatus by the action of a sheet delivery roller 21. After recording sheet P has passed, the transfer roller 18 and separation brush 19 are withdrawn and separate from the circumferential surface of the photoreceptor drum 10 in preparation for the next toner image formation.

After recording sheet P has been separated, residual toner on the circumferential surface of the photoreceptor drum 10 is removed and cleaned by a blade 221 of the cleaning unit 22. Then the photoreceptor drum 10 is electrically discharged by PCL11 and charged by the charger 12, and the next image formation process starts. In this connection, the blade 221 is moved immediately after the cleaning of the photoreceptor surface, so that the blade 221 is withdrawn from the circumferential surface of the photoreceptor drum 10.

Figure 2:
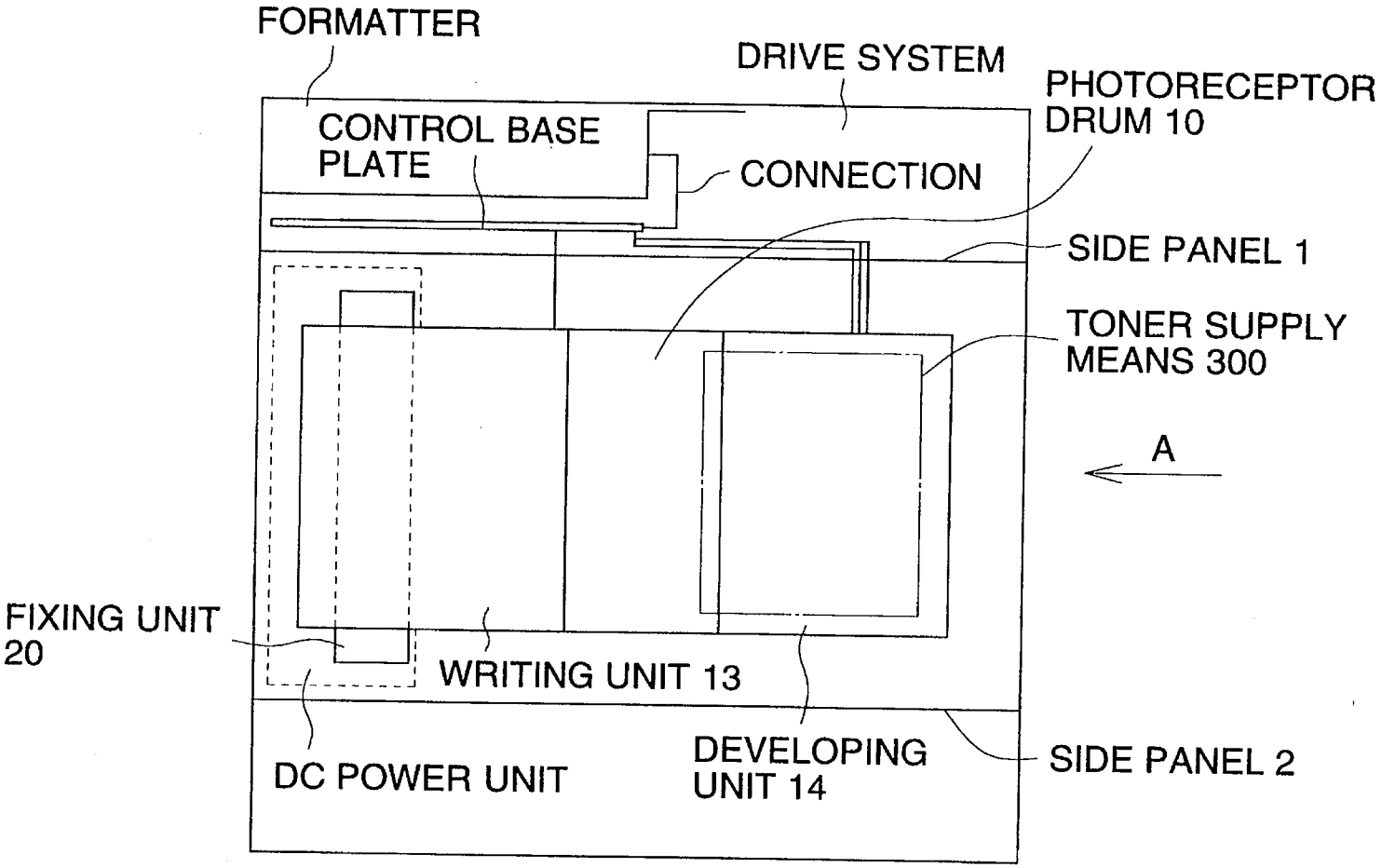
FIG. 2 is a schematic illustration showing the layout of each unit in the apparatus.

FIG. 2 is a view showing the layout of each unit composing the above apparatus. A front side of the apparatus is indicated by arrow A in the drawing, that is, an operation side is indicated by arrow A.

There are provided two side panels 1 and 2 which are vertically attached to the apparatus body. Between the two side panels, there are provided a writing unit which is an image exposure means 13, photoreceptor drum 10, developing unit in which a plurality of developing units 14 are accommodated, fixing unit 20, and DC power unit. Outside the side panel 1, there are provided a drive system, formatter for decoding printer commands, and control base board for controlling the operational sequence of the apparatus. In an upper portion of the developing unit, there is provided a toner supply means connected with each developing unit. The toner supply means will be described later.

Since the photoreceptor drum 10 and the developing unit are located close to the operational side of the apparatus, it is possible to compose the apparatus in such a manner that the photoreceptor drum 10 and the developing unit are easily pulled out from the apparatus to the front side. Further when the upper portion of the apparatus body is opened, the drum frame is pulled out from the apparatus without taking out the developing unit from the apparatus body. It is possible to conduct jam clearance at the transfer position in this way.

It is possible to conduct jam clearance at the sheet feed section when the photoreceptor drum 10 and the sheet feed cassette 15 arranged at a lower position of the developing unit are taken out outside the apparatus. Also, it is possible to conduct jam clearance at the sheet discharge section when a rear side is open.

Characteristics of each unit composing the image forming section will be described below.

Photoreceptor

Figure 3:
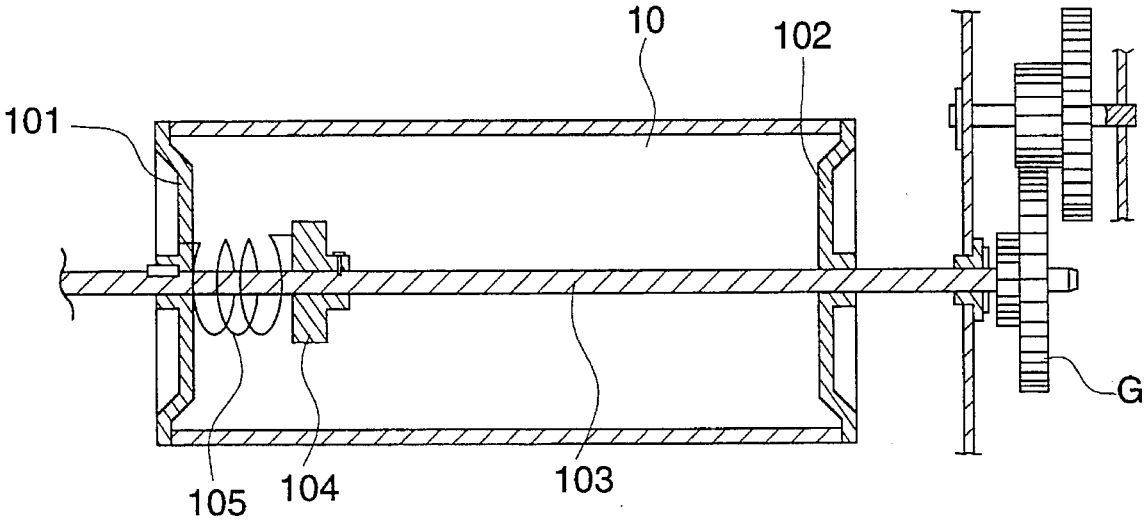
FIG. 3 is a view showing a primary portion of the drive system to drive the photoreceptor.
Figure 4A:
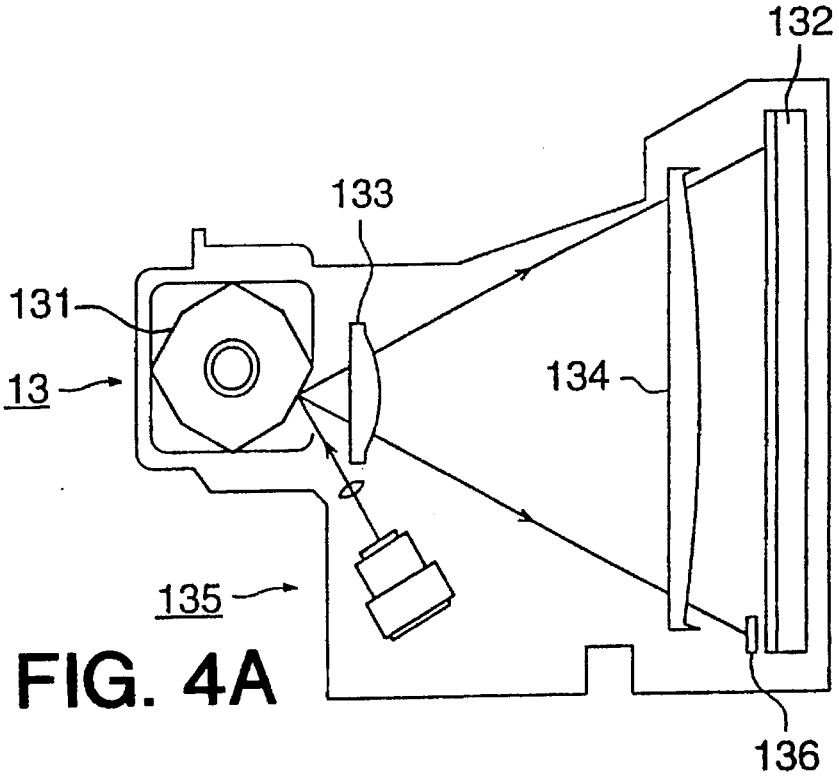
FIGS. 4A, 4B, 4C and 4D are schematic illustrations showing the optical system of the image exposure means.
Figure 4B:
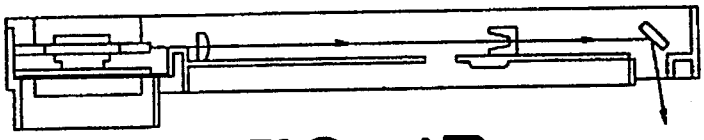
Figure 4C:
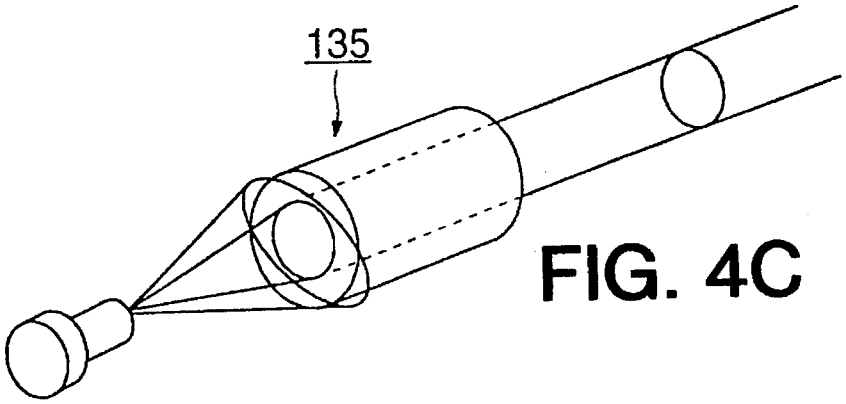
Figure 4D:
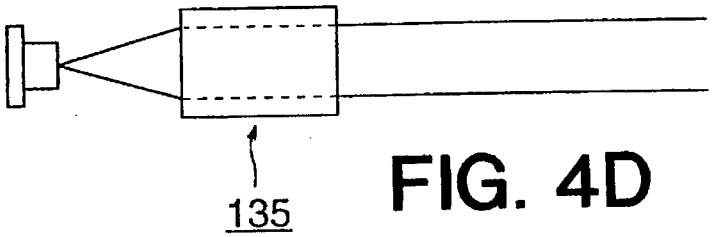

FIG. 3 is a schematic illustration showing a method of transmission of rotational force to the photoreceptor drum 10. The circumferential surface of the drum is supported by two flanges 101 and 102. Both flanges 101, 102 are rotatably attached to the drive shaft 103. A fixing member 104 is fixed to the drive shaft 103, and a spring member 105 is interposed between the fixing member 104 and one 101 of the flanges. Due to the above composition, it is possible to provide the same effect as that of a drive system in which the rigidity of the drive system composed of the photoreceptor drum 10 and drive shaft 103 is low. Therefore, it is possible to lower the characteristic frequency, so that resonance of the drive system can be prevented when the photoreceptor drum 10 is driven by gear G. Fluctuation of rotational speed of the drive shaft 103 is absorbed by the low rigidity member, so that the fluctuation of the rotational speed of the photoreceptor drum 10 can be prevented.

Since the photoreceptor drum 10 is stably rotated, it is possible to uniformly charge the OPC photoreceptor on the photoreceptor drum 10 by the scorotron charger 12. In the case of charging, the grid potential is controlled, so that the charging potential can be stabilized.

For example, the specification of the photoreceptor and the charging condition are set as follows.

Photoreceptor: OPC, ϕ120, Linear speed 100 mm/sec Negative charge

Charging condition:

Charging wire: Platinum wire (clad or alloy) is preferably used.

VH-850 V, VL-50 V

Image Exposure

FIG. 4(*a*) is a plan and side view showing a layout of the image exposure means 13. FIG. 4(*b*) is a schematic illustration of the semiconductor laser unit 135 used for the image exposure means 13.

After the OPC photoreceptor provided on the circumferential surface of the photoreceptor drum 10 has been negatively charged, it is exposed to light emitted by the semiconductor laser unit 135. Therefore, an electrostatic latent image is formed on the OPC photoreceptor.

Image data sent from the formater is transmitted to the laser diode (LD) modulation circuit. When light is emitted by LD of the semiconductor laser unit 135 in accordance with the modulated image signal, scanning lines of the emitted beam of light are synchronized by the beam index 136 through mirrors. Then the beam of light is projected on to the polygonal mirror 131.

Scanning is conducted by the polygonal mirror 131 in such a manner that the beam of light is reflected on the surfaces of the polyhedron of the polygonal mirror 131. The beam of scanning light passes through the fθ lens 133 and the cylindrical lens 134 so that the configuration of the beam is corrected. Then the photoreceptor is exposed to the beam of light through the reflecting mirror 132. In this way, the primary scanning is carried out and an electrostatic latent image is formed on the photoreceptor.

The laser beam is converged corresponding to 600 DPI by the optical system. Accordingly, in order to obtain an image of high quality, it is necessary to reduce the particle size of toner. In this example, the particle size of toner of each color is 8 μm. In this connection, the quality of black characters is most important for users. Accordingly, black toner of small particle sizes (7 to 11 μm) is preferably used.

The composition of an example of the optical system used for image exposure is described below.

Polygonal mirror: 6 faces, rotational speed 23600 rpm Air bearing is used.

Focal distance of lens: f=140 mm

Dot clock: 20 MHZ

Beam diameter: about 60×80 μm

Development

Figure 5:
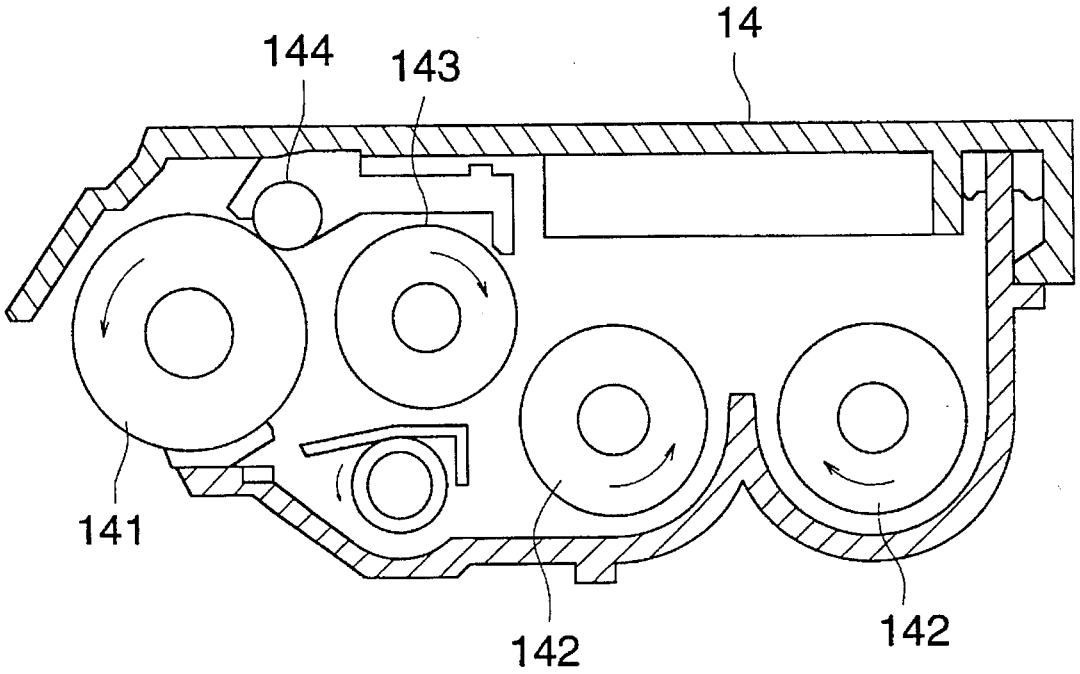
FIG. 5 is a sectional arrangement view of the developing unit.

FIG. 5 is a view showing the composition of the developing unit 14. Toner is supplied from the toner hopper and dropped to the right end of the developing unit. Then toner is agitated by a pair of agitating screws 142 rotating in an opposite direction, so that toner can be mixed with carrier. In this way, toner is charged to a predetermined charging amount (Q/M).

Toner concentration is detected by the magnetic detection system, and an amount of toner supply is controlled in accordance with the output frequency of toner concentration detection. Due to the foregoing, toner concentration is controlled and set to be 5 to 7%.

Two component developer agitated in this way is conveyed to the developing sleeve 141 through the supply roller 143. Thickness of the developer layer is made to be thin by the action of the layer thickness control member 144. Then the thin layer of developer is conveyed to the developing region on the photoreceptor drum 10, and the electrostatic latent image is subjected to reversal development under the following developing conditions.

Development gap: 0.5 mm

Toner conveyance amount: 20 to 30 mg/cm$^2$

Development bias (AC): 2 KV, 8 KHZ (DC): −750 V

Rotational direction of developing sleeve: Normal direction with respect to photoreceptor drum Adjustment of image density: Rotational speed control of developing sleeve, or developing bias control (Reference board is made by a laser beam, and reflecting density is measured after development so as to adjust the image density.)

Toner concentration control: Magnetic detection system

Although not illustrated in the drawing, when a toner bottle assembled to the toner box is used as a toner hoper, the toner supply apparatus can be simplified and made compact, and when the toner bottle is made of opaque material, a residual amount of toner can be easily checked.

Sheet Feeding

Figure 6:
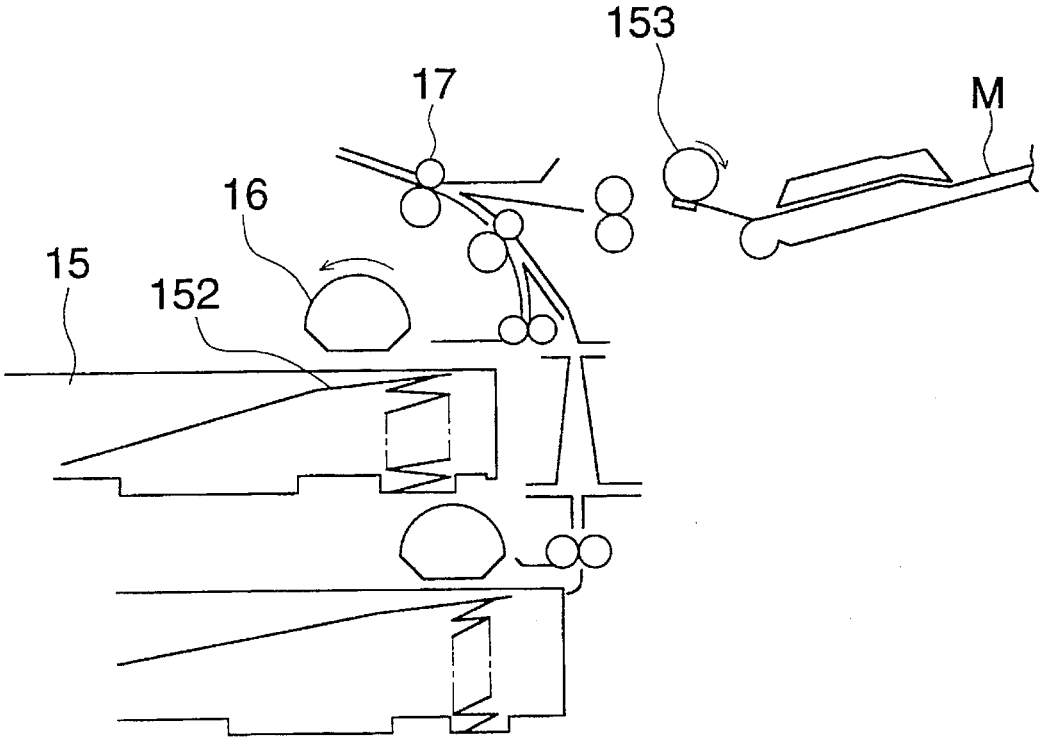
FIGS. 6(*a*) and 6(*b*) are views showing the primary portion of the sheet feed section.
Figure 6:
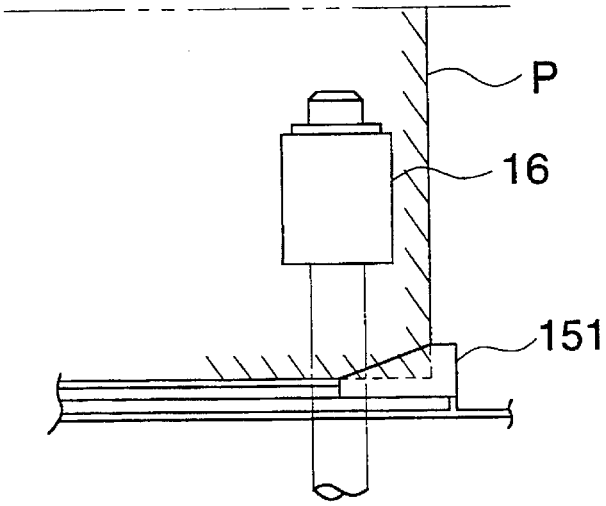

FIGS. 6(*a*) and 6(*b*) are schematic illustrations showing a sheet feed section for feeding recording sheets P. Recording sheet P are accommodated in the sheet feed cassette 15 while one side of the stack of recording sheets P is aligned to be used as a reference. Accordingly, a handling claw 151 is provided only on the reference surface side of the stack of recording sheets P. The semicircular roller 16 is composed in a cantilever structure and located on the reference surface side of recording sheets P.

The sheet feed section is provided with a motor exclusively used for the sheet feed section. The semicircular roller 16 is rotated in the arrowed direction, and only the uppermost recording sheet P stacked on the pushing plate 152 is conveyed out by the action of the handling claw 151.

Recording sheet P conveyed out from the sheet feed cassette 15 enters the conveyance passage and makes a U-turn. Immediately after the leading end has passed through the sheet feed roller 17, the motor is temporarily stopped in accordance with the detection of a sheet sensor not illustrated in the drawing. In timed relation with transfer, the motor is driven again, and recording sheet P is fed to the transfer region while a predetermined angle is maintained with respect to the photoreceptor surface.

In the case of manual sheet feed operation, manual sheet feed tray M located in front of the apparatus body is rotated and set from the position indicated by the one-dotted chain line in FIG. 1 to the position indicated by the solid line.

Manually fed recording sheet P is conveyed by the rotation of the pickup roller 153. The recording sheet is conveyed to the transfer region in the same process as that of the recording sheet sent from the sheet cassette 15.

In the case of manual feeding, sheets of common recording paper P of 16 lbs to 24 lbs are used. Further, sheets of thick paper of 36 lbs and transparent sheets used for OHP are used. It is possible to feed envelopes when the manual feeding tray M is replaced with an optional feeder exclusively used for feeding envelopes.

Transfer

Figure 7:
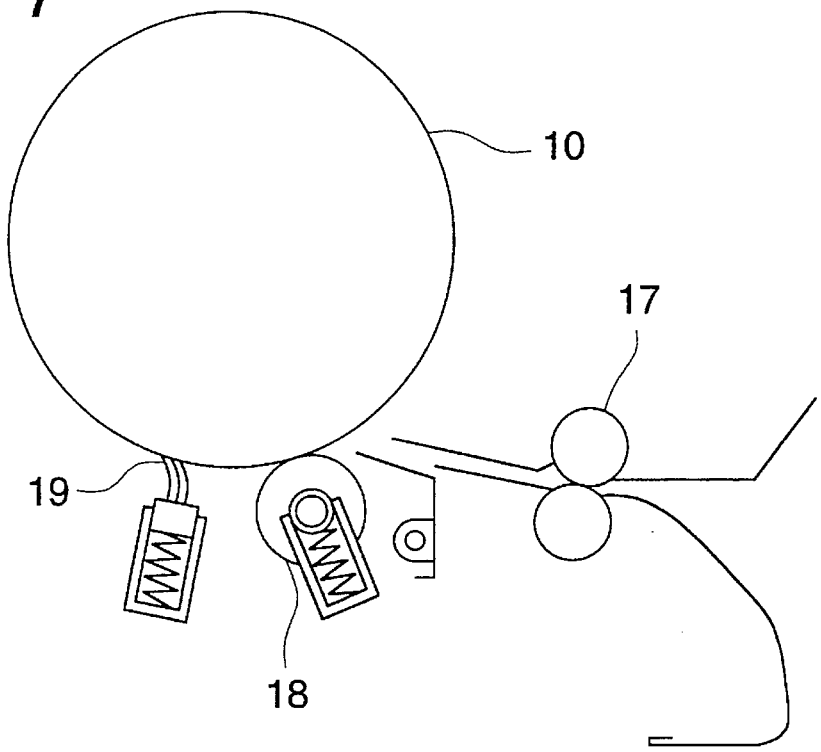
FIG. 7 is a view showing the primary portion of the transfer section.

The position of the transfer roller 18 can be changed with respect to the circumferential surface of the photoreceptor drum 10. When the monochromatic image is printed, the transfer roller 18 always comes into pressure contact with the circumferential surface of the photoreceptor drum 10 as illustrated in FIG. 7. However, in the case of color image formation, the transfer roller 18 is withdrawn from the circumferential surface of the photoreceptor drum 10, and in the case of transfer, it comes into pressure contact with the circumferential surface of the photoreceptor drum 10. Substantially synchronously with the movement of the transfer roller 18, the separation brush 19 is also contacted with and separated from the circumferential surface of the photoreceptor drum 10.

In the apparatus of this example, there is provided a transfer roller 18, the impressed voltage of which is +3 to 4 KV, and the surface of which is cleaned by a blade. A bias voltage in which a DC and AC voltage are superimposed is impressed upon the separation brush 19.

Fixing

Figure 8:
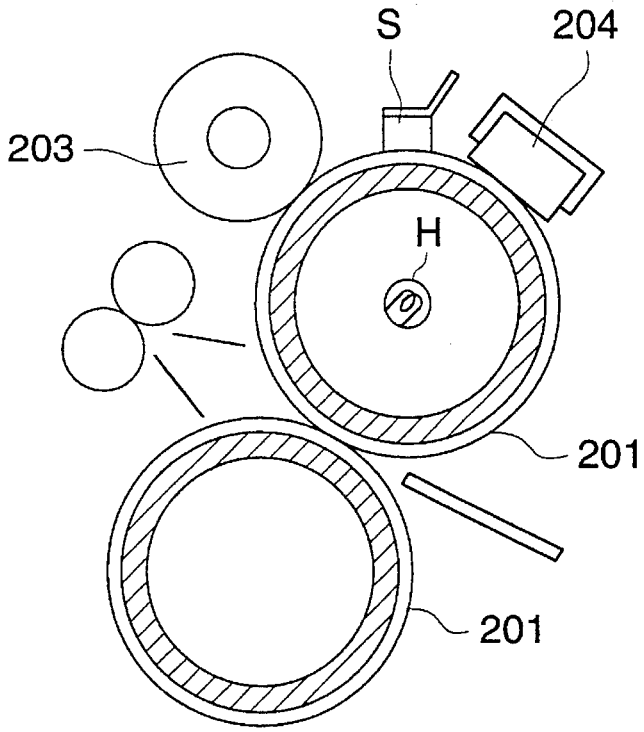
FIG. 8 is a view showing the primary portion of the fixing unit.

The fixing unit 20 used in this example is a heat roller type fixing unit composed of a pair of rollers as shown in FIG. 8. An upper roller 201 includes a heater H and rotates clockwise, and a lower roller 202 idly rotates coming into pressure contact with the upper roller 201. A nip portion is formed by the upper and lower rollers. In the nip portion, recording sheet P is heated and conveyed so that the toner image can be fused.

Both upper and lower rollers are covered with a heat resistant tube. Since the nip portion of the heat rollers is linearly formed by the action of pressure contact, the occurrence of wrinkles which tend to be generated in the conveyance of envelopes can be prevented.

Temperature of the circumferential surface of the upper roller is detected by temperature sensor S and controlled to be in a predetermined temperature range. Stains of toner on the heat rollers are cleaned and removed when the cleaning roller 203 comes into pressure contact with the heat rollers. After several ten thousand of sheets have been printed, the cleaning roller 203 is replaced with a new one. When the heater for fixing is not used over a predetermined period of time, it is set in the SLEEP MODE, and electric power is saved.

When a transparent sheet of OHP is used as a transfer sheet, it is necessary to enhance the transmission factor of a color toner image so that the toner image surface is smoothed for preventing irregular reflection. In order to accomplish the above object, the circumferential surface of the upper roller 201 is coated with silicon oil using an oil pad 204.

Consequently, the transfer sheet conveyance speed of the apparatus of this example is changed over into 3 steps of 100, 50 and 125 mm/sec. When the mode is changed in this way, 3 types of transfer sheets, which are a regular sheet, envelope and transparent sheet, can be used. In this way, the apparatus of this example has various uses.

In this connection, when toner of a low fusing point is used, the setting temperature of the upper roller 201 can be lowered to a temperature of about 180° C. When the oil pad 204 is made of sponge material (porous material covered with PTFE), oil can be uniformly coated on the roller without causing unevenness.

With reference to FIGS. 9 to 14, the attaching and detaching structure of each unit with respect to the apparatus body will be explained below.

The photoreceptor drum 10 and the units arranged on its circumferential surface such as a PCL11, charger 12, developing unit 14 and cleaning unit 22 are mounted on a drum frame 30, so that the above units are integrated into one body.

Figure 9:
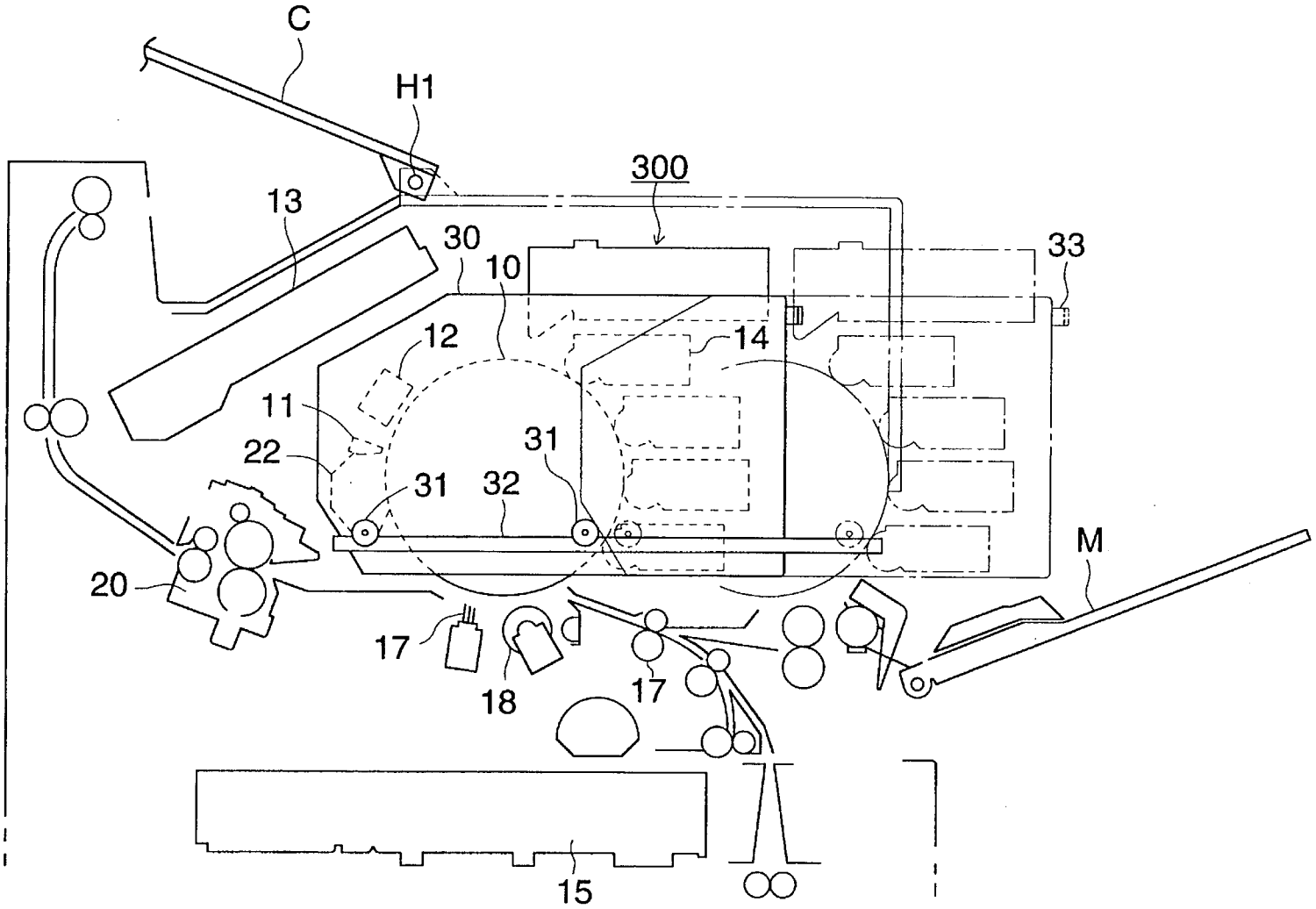
FIG. 9 is a schematic illustration showing the setting and moving positions of the drum frame.

As illustrated in FIG. 9, the drum frame 30 is provided in such a manner that pairs of rollers 31 arranged on both sides of the drum frame 30 are engaged with rail members 32 arranged in the apparatus body and fixed at a predetermined position by an engaging device not shown which can be released when necessary.

The drum frame 30 can be pulled out from the apparatus body in the following manner:

The manual feed tray M is opened and set at a sheet supply position. Cover member C which covers an upper portion of the apparatus body is rotated around support shaft H1. Then a handle is pulled, so that the drum frame 30 can be moved to right on the rail members 32 to a position illustrated by a one-dotted chain line.

As a result of the above operation, the transfer region and the successive sheet conveyance passage are widely opened. Therefore, it becomes possible to put the operator's hand into the apparatus for jam clearance without touching the drum frame 30 and other units in the apparatus. In this connection, jam clearance in the sheet feed section is carried out when the sheet feed cassette 15 is pulled out to right, that is, when the sheet feed cassette 15 is pulled out to the front side of the apparatus.

Figure 10:
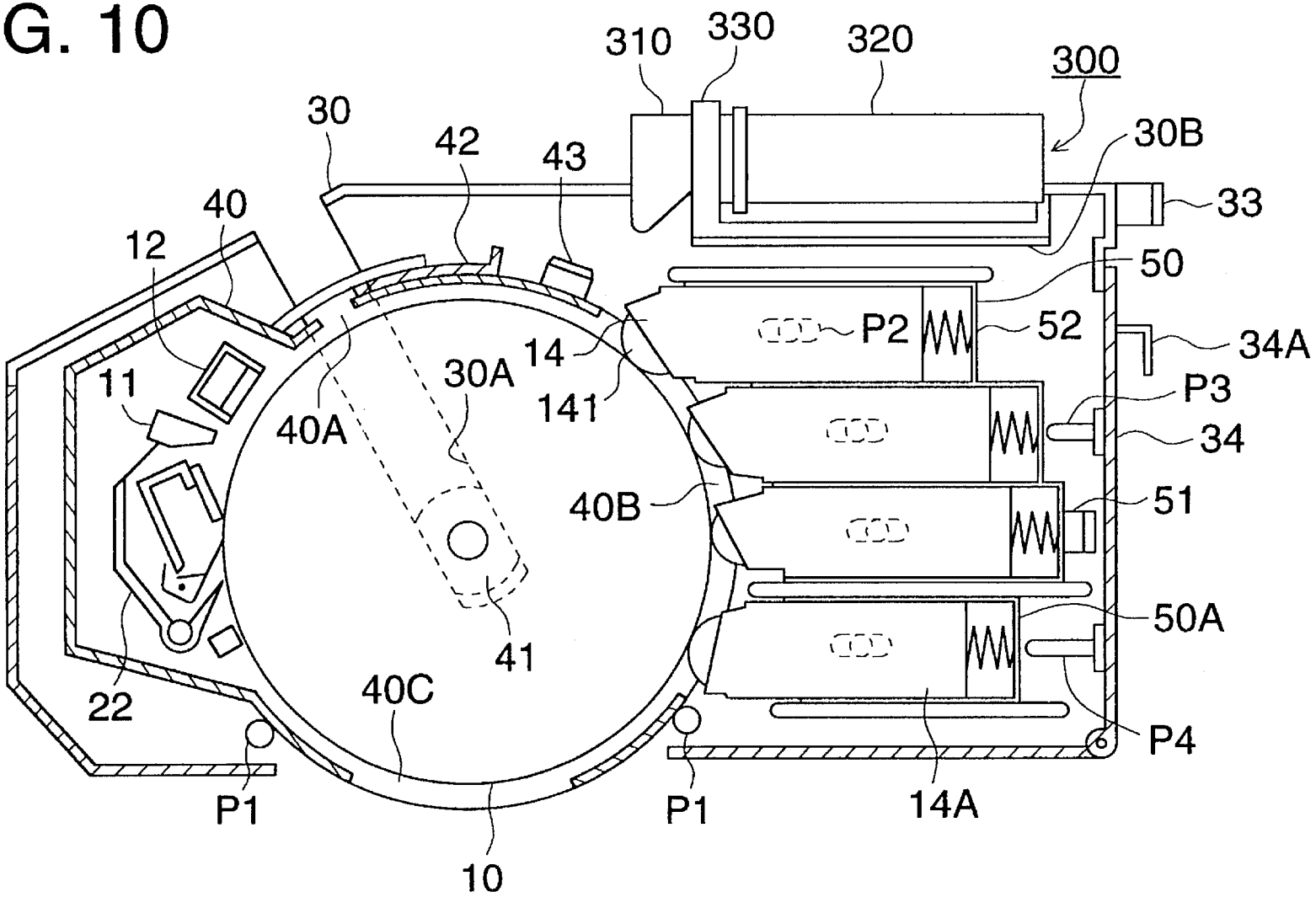
FIG. 10 is a sectional arrangement view of the drum frame.

As illustrated in FIG. 10, the drum cartridge 40, developing cartridge 50 and developing cartridge 50A are mounted on the drum frame 30, wherein the drum cartridge 10 and others are assembled to the drum cartridge 40, the developing units 14 containing developers of Y, M and C are assembled to the developing cartridge 50, and only the developing unit 14A containing developer of K is assembled to developing cartridge 50A.

The photoreceptor drum 10, PCL11, charger 12 and cleaning unit 22 are assembled to the drum cartridge 40. All photoreceptor surface is covered except for portions of the openings 40A, 40B and 40C corresponding to the exposure, development and transfer regions.

The drum cartridge 40 is set at a predetermined image forming position in the following manner:

A bearing section 41 of the photoreceptor drum 10 is engaged with a longitudinal groove 30A of the drum frame 30. A bottom section of the photoreceptor drum 10 is contacted with pairs of position regulating pins P1 respectively provided on both insides of the drum frame 30. In this way, the rotation of the photoreceptor drum 10 is prevented, and the horizontal and vertical positions are restricted. Under the above condition, each unit is set at a predetermined image forming position.

The opening 40A is an exposure region of the drum cartridge 40. In the opening 40A, a long and slender slit hole, through which the writing beam can pass, is formed and a slide type shielding plate 42 is provided. Therefore, it is impossible for an operator to put his hand onto the photoreceptor surface.

Due to the above structure, even when the drum frame 30 is moved to right for jam clearance, the sheet feed section or the multi-feeder tray is located immediately below the drum frame. Accordingly, the photoreceptor surface is not substantially exposed. Therefore, the photoreceptor surface is not stained by the operator's hand.

Concerning the developing cartridges 50 and 50A, position regulating pins P2 protruding from developing units are engaged with long holes formed on both sides. Under the above condition, the developing cartridges 50 and 50A are pushed by the compression springs 52.

The developing cartridges 50 and 50A are pushed to left by the pushing pins P3 and P4 provided on the side door 34 which forms the right side of the drum frame 30. Each developing sleeve 141 and collision roller (not shown) mounted on the same shaft come into pressure contact with the circumferential end surface of the photoreceptor drum 10, so that the developing clearance between the photoreceptor surface and each developing sleeve surface can be set to a predetermined value.

In the drum frame 30, a plurality of toner supply means 300 for supplying toner to the developing units are integrally provided on an upper surface of the mount 30B provided in the upper portion.

Figure 11:
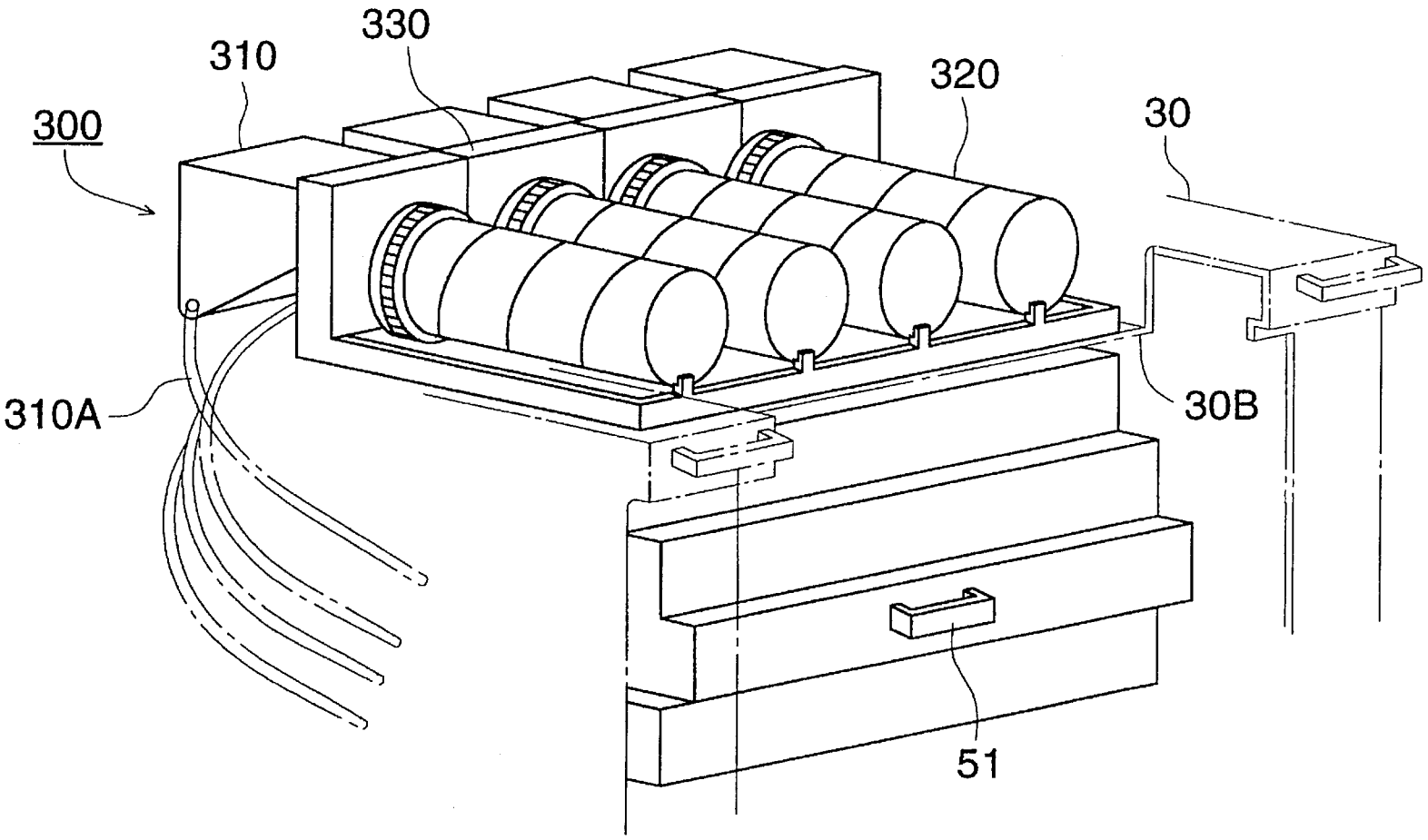
FIG. 11 is a perspective view of the toner supply means and developing cartridge.

The toner supply means 300 is composed of a toner hopper 310 connected with the developing unit through a toner conveyance pipe 310A, and an attaching section 330 horizontally attached to the toner cartridge 320 of the present invention. As illustrated in FIG. 11, the toner supply means are arranged adjacent to each other on the same surface as that of the developing sleeve 141 of the developing unit 14.

The toner conveyance pipe 310A is attached to and detached from each developing unit through a connecting section when each developing unit is replaced. In other words, in the case of jam clearance and replacement of the drum cartridge, the toner conveyance pipe and the connecting section of the developing unit are not separated, and only when the developing unit is taken out, the connecting section is detached. Therefore, each unit is seldom stained with toner. Further, in the case of removal of the drum frame 30, it is not necessary to detach the toner supply means 300 from the developing unit 14. Therefore, the structure of the apparatus can be simplified, and the apparatus becomes handy.

Since the toner cartridge 320 and the toner hopper 310 are arranged on the same surface, the height of the toner supply means 300 is reduced, so that the dimensions of the overall apparatus can be reduced.

Figure 12:
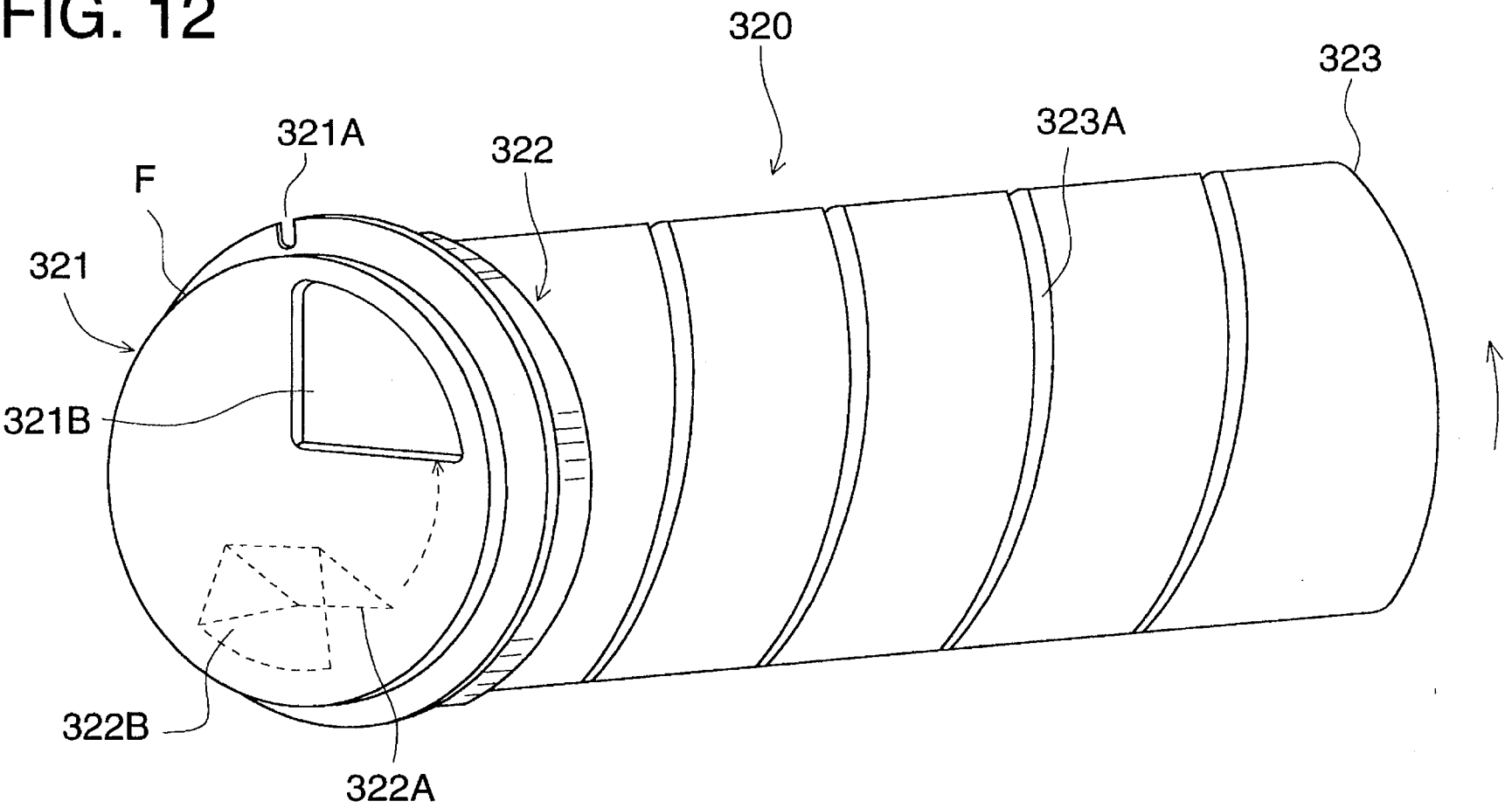
FIG. 12 is a perspective view of the toner cartridge.
Figure 13B:
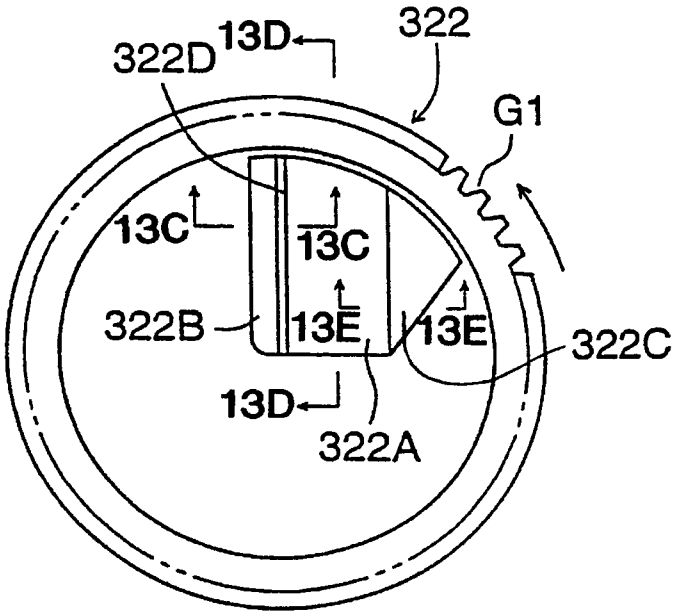
FIGS. 13A, 13B, 13C, 13D and 13E are views showing the primary portion of the toner cartridge.
Figure 13E:
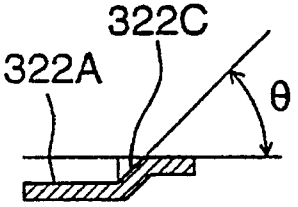
Figure 13D:
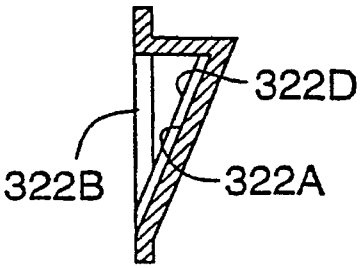
Figure 13C:
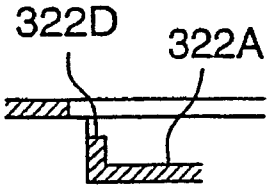
Figure 13A:
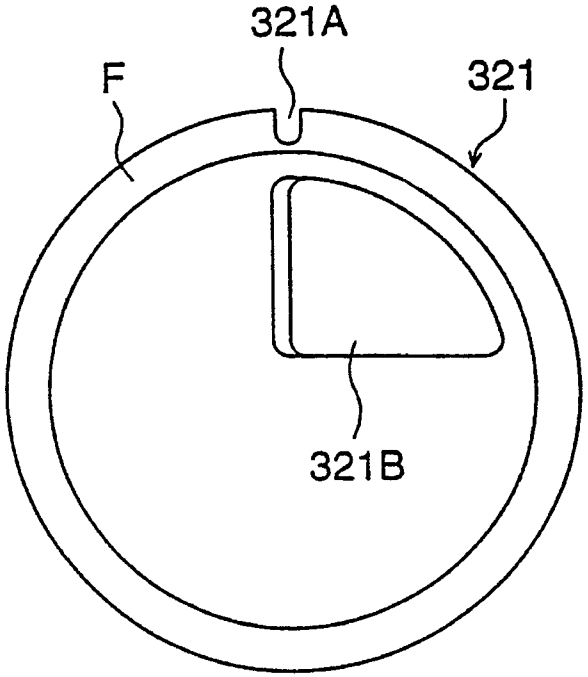

FIGS. 12 and 13 are views showing the appearance and the primary portion of the toner cartridge 320 described before. The toner cartridge 320 includes: a first portion composed of a cylindrical toner accommodating container 323, on the inner circumferential surface of which a spiral protrusions 323A is provided, and a movable member 322 having a scooping portion 322A fixed onto the end face; and a second portion composed of a fixed member having a toner discharge port 321B, wherein the fixed member slidably comes into contact with the movable member 322 so that toner can be tightly sealed up.

As illustrated in FIG. 13(*a*), the fixed member 321 is composed in such a manner that a cut-out 321A is formed on the flange F, and a substantially semicircular toner discharge port 321B is formed on the disk portion. On the other hand, as illustrated in FIG. 13(*b*) and the sectional view showing the section B—B, the movable member 322 includes: an opening 322B for discharging toner from the toner discharge port 321B of the fixed member 321; and a scooping portion 322A arranged under the condition that the scooping portion 322A is inclined by a predetermined angle with respect to a plane including the rotational axis center of the movable member 322, while the scooping portion 322A is inclined facing the opening 322B.

As illustrated in the sectional views of AA to CC, when the movable member 322 is rotated counterclockwise, the opening 322B and the scooping portion 322A are connected with each other by an inclined surface 322C, the inclination angle of the end surface of which on the opposite side to the rotational center is θ. An appropriate rising portion 322D is formed in the periphery of the scooping portion 322A in the direction of the rotational center.

A spiral protrusion 323A is formed inside of the container 323. The section of the spiral protrusion 323A is approximately triangular, and a left spiral angle is provided to the protrusion 323A. The spiral protrusion 323A is made of resin together with the container body.

Under the condition that the container 323 is filled with toner, the movable member 322 and the container 323 are integrated by means of adhesion, and the fixed member 321 is attached onto the front of the movable member 322 by means of press-fitting so that an appropriate frictional force is given. In this way, the movable member 322 and the container 323 are rotatably supported. In the case where the cartridge is not used, the fixed member 321 is rotated, and the toner discharge port 321B is displaced from the position of the opening 322B of the movable member 322, so that toner is prevented from leaking out.

Figure 14:
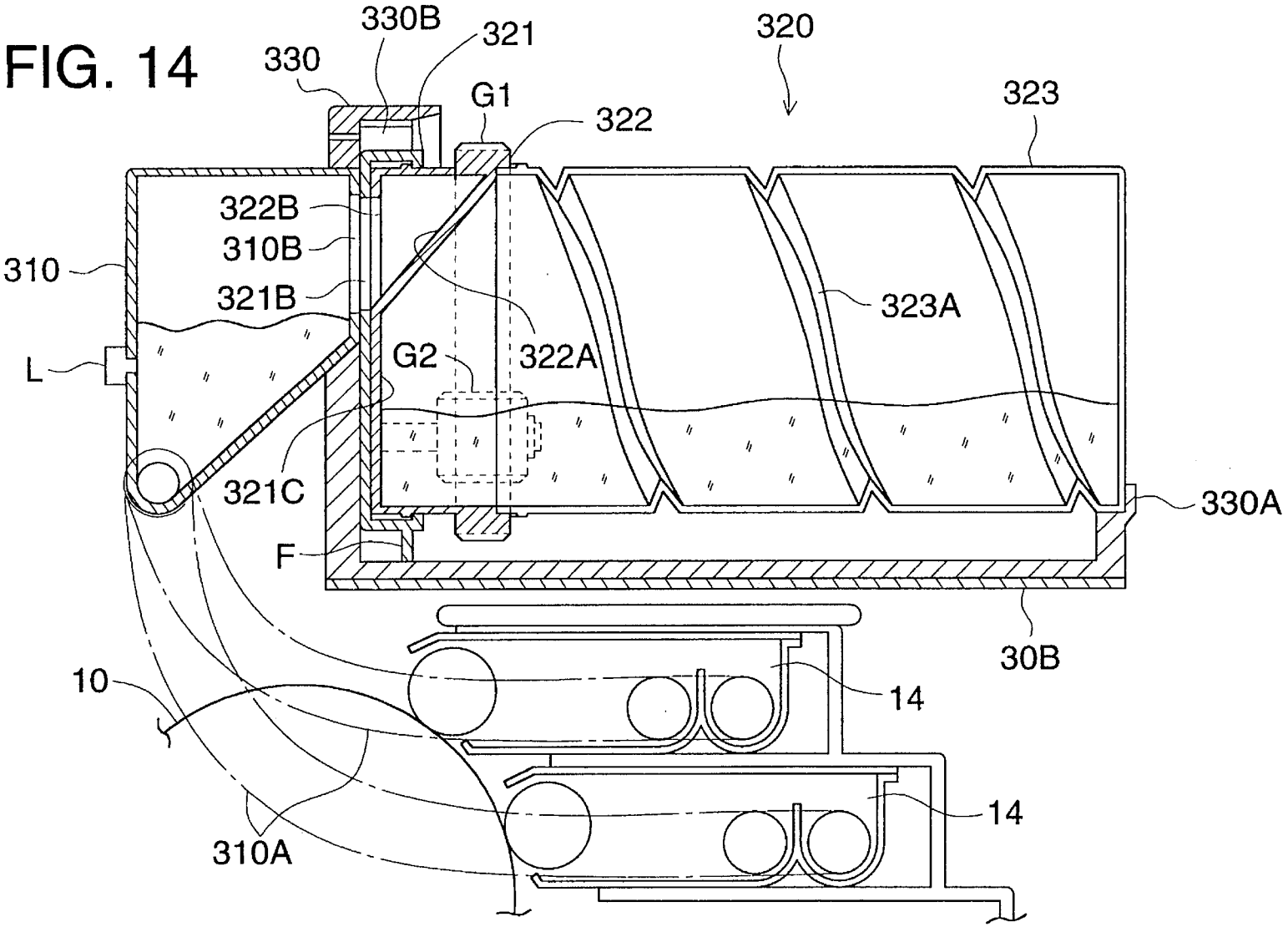
FIG. 14 is an arrangement view of the toner supply means.

As illustrated in FIG. 14, the toner cartridge 320 is attached in such a manner that the flange F is engaged with the attaching section 330, and further a rear end of the container 323 is engaged with a resilient claw protruding from the base of the attaching section 330. At this time, the cut-out 321A of the flange F of the fixed member 321 is engaged with the position restricting pin 330B of the attaching section 330, so that the upper position of the toner discharge port 321B is restricted, and at the same time the rotation is blocked. Further, gear G1 of the movable member 322 is meshed with gear G2 provided in the attaching section 330.

Gear G2 is meshed with both gears G1 of the toner cartridges 320 arranged adjacent to each other. Therefore, when one of gears G1 is driven by the drive system of the attaching section 330, the movable members 322 and containers 323 of all toner cartridges 320 are simultaneously rotated.

Toner is supplied to the toner hopper 310 from the toner cartridge 320 as follows.

Each toner hopper 310 is provided with a toner sensor L so that an amount of toner is always detected by the toner sensor L, and the detection signal is inputted into the control section. When toner is supplied to the developing unit 14, an amount of toner in the hopper 310 is reduced to a value lower than a predetermined value. When this signal is obtained, the control section controls the drive system of the attaching section 330, so that gear G2 is driven and each toner cartridge 320 is rotated counterclockwise in FIG. 13 while the fixed member 321 is engaged with the toner cartridge 320.

Since the toner cartridge is arranged approximately horizontally, toner is located in the lower portion of the toner cartridge as illustrated in FIG. 14. When the toner cartridge 320 is rotated, toner in the container 323 is conveyed forward (to the left in FIG. 14) by the thrust of the spiral protrusion 323A.

Figure 16A:
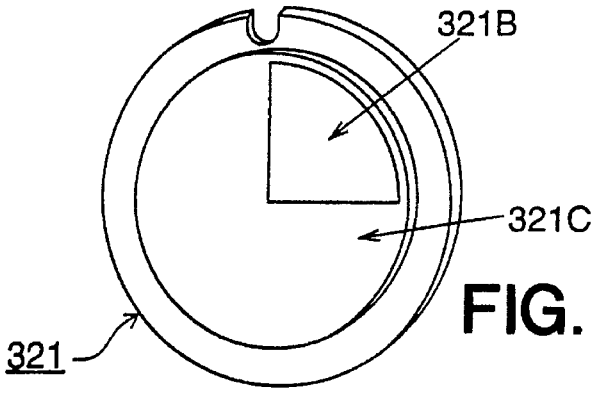
FIG. 16 is a schematic illustration for explaining the function of toner conveyance from the cartridge.
Figure 16B:
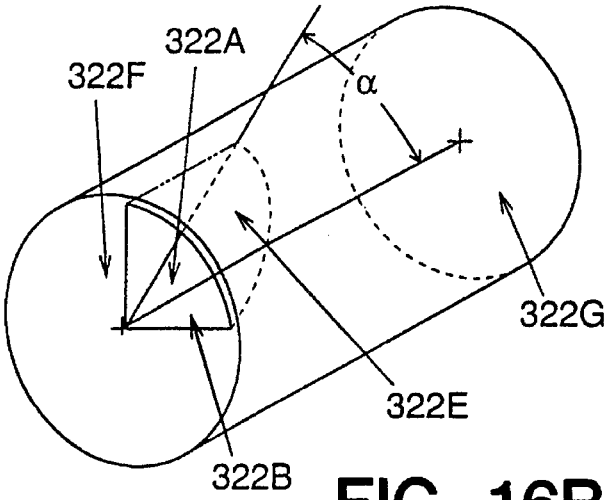
Figures 16C, 16D, 16E, 16F:
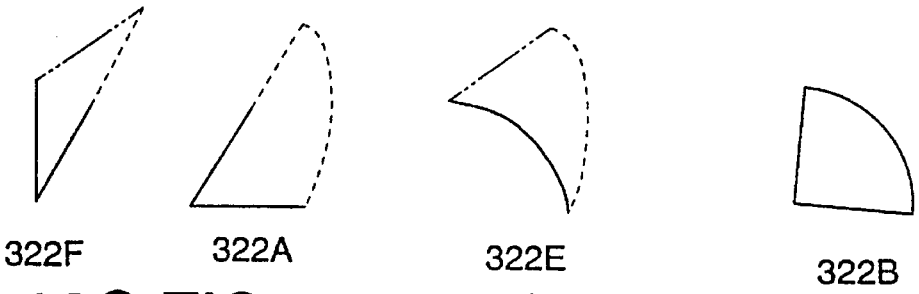

When toner is conveyed into the movable member 322, in accordance with the rotation of the toner cartridge, toner is caught by the scooping member 322A from the opening 322F for scooping toner provided in the toner cartridge in the rotational direction with respect to the scooping member 322A in FIG. 16 described later. As illustrated in FIG. 16, the structure having a scooping function includes: a scooping portion 322A; a portion 322E on the inner wall surface of the movable member 322; a disk-shaped inner wall surface 321C of the fixed member 321 which functions to prevent toner from spilling from the toner discharge port 321B in the case of scooping toner; and a toner scooping opening 322F which is an entrance for scooping toner. As illustrated in FIG. 16, the configuration of the scooping section 322A is the same as a portion of an ellipse which is obtained when a cylinder is cut on a surface. In the present invention, a very effective toner discharging action is provided by an inclined surface inclined with respect to the scooping section 322A or a curved surface 322C and by the rising portion 322D.

Two-dotted chain line in the drawing indicating a portion 322E of the inner wall surface of the cylindrical container and an opening 322F for scooping shows an imaginary position when consideration is given to a space including 4 surfaces 322A, 322B, 322E, 322F obtained by the scooping portion 322A.

When the movable member 322 is rotated, toner is scooped by the scooping portion 322A and the portion 322E of the inner wall of the movable member 322. The thus scooped toner is slidably contacted with the inner wall surface 321C of the fixed member 321, and rotated and conveyed to a position facing the toner discharge port 321B.

Figure 15:
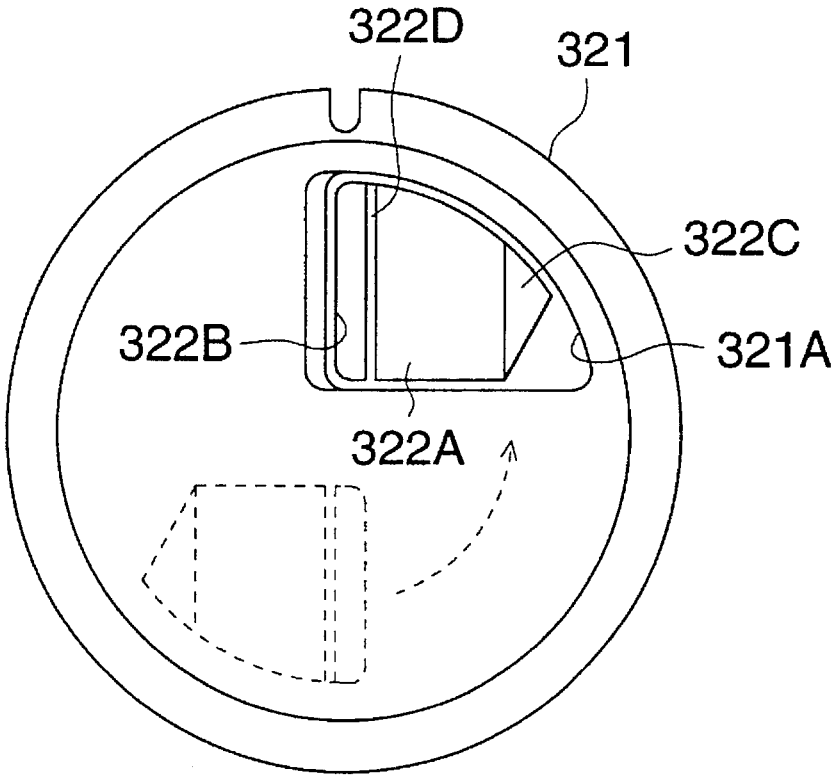
FIG. 15 is a schematic illustration for explaining the toner supply action.

As illustrated in FIG. 15, toner conveyed to the position facing the toner discharge port 321B is separate from the inner wall surface 321C of the fixed member 321. As a result, toner slides down on the inclined surface of the scooping portion 322A by its own weight and is supplied into the toner hopper 310 from the toner supply port 310 of the toner hopper 310 through the toner discharge port 321B.

Since the toner cartridge is arranged horizontally, when an angle $\alpha$ formed between the horizontal surface 322G including the rotational center axis of the toner cartridge perpendicular to the direction of gravity and the scooping portion 322A is larger than the angle of repose, the toner discharging performance can be stabilized. For the purpose of reducing the compressive force applied to toner in the case of scooping and also for the purpose of discharging toner by one operation, the inclined surface 322C described before is provided at the periphery of the scooping portion 322A. That is, when an angle formed between the inclined surface 322C and a tangent at the point where the periphery is contacted with the inner wall surface of the movable member 322 is made large, the toner compressive force can be reduced in the process of scooping. At the rotational position before the discharge port 322 of the movable member 322 coincides with the discharge port 321B of the fixed member 321 and the scooped toner is discharged, an angle formed between the inclined surface 322C and the horizontal surface 322G is made larger than the angle of repose. Due to the foregoing, toner held by the inclined surface 322C and the inner wall surface 322E can be guided to the toner scooping portion 322A. When the rising portion 322D is provided at the periphery of the scooping portion 322A in the rotational direction, the scooped toner can be prevented from returning to the cartridge, so that the toner is effectively discharged. It is sufficient that the height of the rising portion 322D is several mm so that opening 322F is not blocked.

As described above, toner is supplied from an upper position of the cartridge. Therefore, it is possible to arrange the toner hopper 310 at a position higher than the toner cartridge 320. As a result, a space under the toner hopper can be effectively utilized.

When the toner concentration detecting sensor detects that the toner concentration of a developing unit has been decreased lower than a reference value, the signal is sent to the control section, and an amount of toner corresponding to the signal is conveyed from the toner hopper to the developing unit through the toner conveyance pipe 310A by the rotation of a conveyance screw.

As described above, with respect to each developing unit, toner is stored in two steps, one is the toner cartridge and the other is the toner hopper. The toner cartridge supplies toner to the corresponding toner hopper, and the toner hopper supplies toner to the corresponding developing unit.

Figure 17:
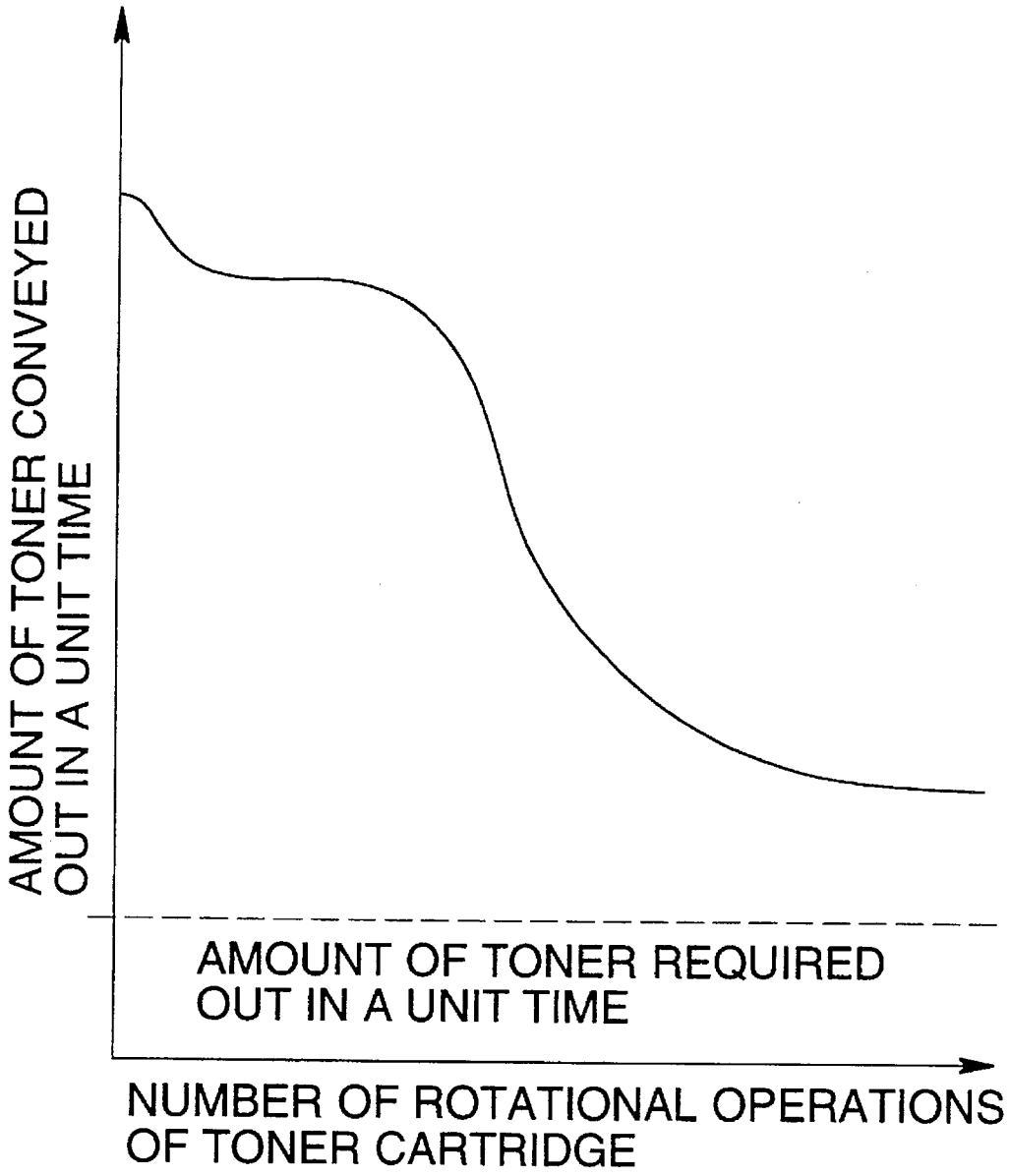
FIG. 17 is a graph showing a change in the amount of toner conveyed out from the cartridge.

As shown in the graph of FIG. 17, an amount of toner conveyed out from the toner cartridge 320 is lowered as the number of the cartridge rotation operation is increased. However, when the amount of toner discharged from the toner cartridge is made to be larger than the amount of toner consumed by the developing unit, a predetermined amount of toner is always stored in the toner hopper 310, so that no problems are caused in toner supply.

Since the scooping portion 322A is arranged being connected with the inner wall surface of the movable member 322, even if an amount of toner in the container 323 is reduced, it is possible to effectively convey and discharge toner. When the toner hopper 310 is fully filled with toner, the scooped toner is returned to the container 323. Therefore, the mechanism is reasonably operated. Even when toner is supplied to a specific toner hopper 310, it is possible to simultaneously rotate all toner cartridges. Accordingly, the drive system mechanism and the control circuit can be simplified. The reason of simplification of the structure is that toner is discharged from the toner cartridge to the toner hopper by the action of its own weight, and toner is sent from a toner supply port on the side of the toner hopper, so that a space is provided in the upper portion of the toner hopper, and toner is not excessively supplied.

In this connection, at the closed position, the side door 34 is fixed at an engaging position in such a manner that it resists the reaction force of the compression spring 52.

Consequently, only when the developing unit is replaced, it is necessary to disconnect the developing unit and toner supply means 300 from the apparatus. Therefore, the frequency of connection and disconnection of the toner supply pipe 310A is reduced, and there is no possibility of scatter and leakage of toner. Accordingly, the apparatus can be always maintained in a clean condition.

Further, the toner cartridge can be attached to and detached from the apparatus on the front side. Therefore, the apparatus is very handy.

According to the toner cartridge of the present invention, it is possible to effectively supply and discharge toner irrespective of an amount of toner accommodated in the toner cartridge. Even when the toner cartridge is fully filled with toner, operation can be successively continued without causing any problems. Consequently, the mechanism of the drive system can be simplified.

The toner scooping portion is provided with an inclined surface in the inner circumferential direction which is an external side in the direction of radius of curvature of the toner cartridge. Due to the foregoing, sliding and discharging of the scooped toner can be facilitated. Further, when a rising portion is provided on the central side of the direction of radius of curvature, the scooped toner can be effectively conveyed. Therefore, toner can be discharged and supplied by a simple drive system in which gears are used. Accordingly, it is possible to provide a toner cartridge suitable for practical use.

According to the present invention, the toner supply section is arranged on the same surface in the upper portion of a plurality of developing units while the toner supply section is installed in parallel with the direction of the sleeve shaft of the developing unit. In this way, the dimensions of the apparatus can be reduced, and further toner can be uniformly supplied from above on the front side of the apparatus, the maneuverability of the apparatus can be enhanced. When the drum frame is pulled out from the apparatus in the case of jam clearance, since a plurality of developing units and toner supply sections are integrally provided in the drum frame, it is not necessary to disconnect the connecting section of the toner supply section and the developing unit. Accordingly, the apparatus is not stained with toner and each unit can be maintained in a clean condition. Only when each developing unit is replaced, it is necessary to disconnect the connecting section. In this case, the connecting section is covered with a conventional shutter so as to prevent the apparatus from being stained with toner.

Concerning the layout of each unit of the apparatus, as described in the example, the other supply section is arranged at the lateral position. Accordingly, it is possible to arrange the toner supply section in a space provided in the height direction of the writing unit and the sheet stacking section. Therefore, the dimensions of the image forming apparatus can be reduced to the minimum.

Since the toner supply section provided at the lateral position is divided into the toner cartridge and toner hopper, even when toner in the toner cartridge has been consumed, a small amount of toner is left in the toner hopper. Therefore, it is possible to continue the printing operation until the replacement of the toner cartridge, so that the workability is enhanced. Further, toner is supplied from the side to the toner hopper at a position higher than the rotational axis center of the cartridge. Accordingly, even when the toner hopper is fully filled with toner, toner is not excessively supplied, and toner can be simultaneously supplied to all cartridges. Therefore, the mechanism and control system of the drive system can be simplified and the costs are reduced.

Due to the foregoing, the working efficiency of jam clearance, toner supply and maintenance can be enhanced, and the apparatus can be made compact at low cost.

What is claimed is:

1. A toner supplying apparatus for supplying a toner to a developing station of an image forming machine, comprising:

a toner cartridge;

a toner receiver means for receiving said toner from said toner cartridge and for conveying said toner to said developing station;

said toner cartridge including:

a cylindrical container for accommodating toner therein; wherein said cylindrical container includes an spiral protrusion, provided on an inner circumferential surface of said cylindrical container, for conveying said toner in a direction of an axis in said cylindrical container when said cylindrical container is rotated on said axis;

wherein said toner cartridge and said toner receiver are arranged on a same horizontal plane; and a scooper for scooping said toner conveyed by said spiral protrusion and for discharging said toner to said toner receiver; said scooper operating to scoop said toner during said rotation of said cylindrical container.

2. The apparatus of claim 1, wherein said cylindrical container has a first wall member on said axis; and said first wall member has an opening at a position in a direction above a horizontal line extended through said axis, and said scooper discharge said toner to said toner receiver through said opening.

3. The apparatus of claim 2, wherein said first wall member is arranged rotatable in relation to said cylindrical container so as to position said opening at said upper position when said cylindrical container is rotated on its axis.

4. The apparatus of claim 3, wherein said scooper is attached to said cylindrical container so as to rotate with said cylindrical container.

5. The apparatus of claim 2, wherein said scooper includes a second wall member having an inclined surface; and said toner is discharged to said toner receiver falling on said inclined surface when said second wall member faces to said opening during a rotation of said cylindrical container.

6. The apparatus of claim 5, wherein said second wall member has a rising portion at an end where said second wall member is separated from said first wall member.

7. The apparatus of claim 2, wherein said scooper is attached to said cylindrical container so as to rotate with said cylindrical container.

8. The apparatus of claim 1, wherein said scooper is attached to said cylindrical container so as to rotate with said cylindrical container.

9. The apparatus of claim 1, wherein said cylindrical container includes:

a coupling member for coupling said cylindrical container to a driving member of the image forming machine so that said cylindrical container is rotated by said driving member.

10. The apparatus of claim 1, wherein the apparatus has a plurality of said toner cartridges and a plurality of said toner receivers, and wherein the apparatus further comprises:

a plurality of toner sensors, each toner sensor is provided on one of said plurality of toner receivers, for detecting an amount of said toner in said one of said plurality of toner receivers and a controller for controlling the apparatus to supply said toner simultaneously to all said plurality of toner receivers by said scooper, said scooper provided in each of said plurality of toner cartridges, when at least one of said plurality of toner sensors detects an amount of said toner that is a lower amount than a predetermined amount.

11. A toner cartridge in use with an image forming apparatus, comprising:

a cylindrical container for accommodating toner therein; said cylindrical container including an spiral protrusion, provided on an inner circumferential surface of said cylindrical container, for conveying said toner in a direction of an axis in said cylindrical container when said cylindrical container is rotated on said axis; wherein said cylindrical container has a first wall member on said axis; and said first wall member has an opening at a position in a direction above a horizontal line extended through said axis; and a scooper for scooping said toner conveyed by said spiral protrusion and for discharging said toner through the opening.

12. The toner cartridge of claim 11, wherein said first wall member is arranged rotatable in relation to said cylindrical container so as to position said opening at said upper position when said cylindrical container is rotated on its axis.

13. The toner cartridge of claim 11, wherein said scooper is attached to said cylindrical container so as to rotate with said cylindrical container.

14. A color image forming apparatus, comprising:

an image forming body for forming a toner image on a surface thereof;

a charger for charging said image forming body;

an exposure device for forming a latent image on said surface of said image forming body;

a plurality of developers, each having a developing sleeve, for developing said latent image with toner to form said toner image;

a plurality of toner suppliers each supplying said toner to one of said plurality of developers;

wherein each of said plurality of toner supplier includes a toner cartridge and a toner receiver for receiving said toner from said toner cartridge so that said plurality of toner suppliers has a plurality of toner cartridges and a plurality of toner receivers; and said plurality of toner suppliers is aligned in a same horizontal plane, and is arranged on said plurality of developers; and a frame member for uniform support of said plurality of developers and said plurality of toner suppliers;

wherein said frame member is movably supported between a first position, in which the color image forming apparatus is operable to form said toner image, and a second position being apart from said first position.

15. The apparatus of claim 14, wherein each of said plurality of toner cartridges has a cylindrical container so that said plurality of toner cartridges have a plurality of cylindrical containers; and said plurality of cylindrical containers are aligned parallel on an axis of a developing sleeve of said plurality of developing means so as to form a toner cartridge group on a same plane.

16. The apparatus of claim 14, wherein said frame member is movable in a direction of an axis of said plurality of cylindrical containers; and said apparatus further comprising:

a cover member for covering an upper portion of the apparatus; said cover member being arranged on an upper position of said frame member.

* * * * *